US010932643B2

(12) United States Patent
Omotola

(10) Patent No.: US 10,932,643 B2
(45) Date of Patent: Mar. 2, 2021

(54) SCRAPER SPONGE

(71) Applicant: Alahandro Olatunde Omotola, Leesburg, VA (US)

(72) Inventor: Alahandro Olatunde Omotola, Leesburg, VA (US)

(73) Assignee: Alahandro Omotola, Leesburg, VA (US)

( * ) Notice: Subject to any disclaimer, the term of this patent is extended or adjusted under 35 U.S.C. 154(b) by 9 days.

(21) Appl. No.: 16/602,099

(22) Filed: Aug. 12, 2019

(65) Prior Publication Data

US 2019/0365188 A1 Dec. 5, 2019

Related U.S. Application Data

(60) Provisional application No. 62/917,756, filed on Dec. 31, 2018.

(51) Int. Cl.
*A47L 13/12* (2006.01)
*A47L 13/16* (2006.01)
(Continued)

(52) U.S. Cl.
CPC ..... *A47L 13/08* (2013.01); *A47L 13/02* (2013.01); *A47L 13/12* (2013.01); *A47L 13/16* (2013.01)

(58) Field of Classification Search
CPC ..... A47L 13/02; A47L 13/08; A47L 13/12; A47L 13/16
See application file for complete search history.

(56) References Cited

U.S. PATENT DOCUMENTS 2,066,420 A * 1/1937 Reysa ..... A47L 17/04 15/105
4,055,029 A * 10/1977 Kalbow ..... A47L 13/16 451/527
(Continued)

FOREIGN PATENT DOCUMENTS

DE 10164757 A1 * 6/2003 ..... A47L 17/06

OTHER PUBLICATIONS

DE 10164757 A1—English Machine Translation (Year: 2003).*

*Primary Examiner* — Marc Carlson

(57) ABSTRACT

A scraper sponge for cleaning and scraping away unwanted substances from an object or surface comprising a sponge body defining a first surface, first layer, second layer, third layer, second surface opposite the first surface, a continuous side surface around the perimeter; and the back of a scraper secured to the first layer opposite the first surface and the scraper defined by the first layer and an aperture through and approximately in the middle of the second layer, third layer and second surface of the sponge body. The entire surface area of the scraper, on it's front surface, is covered with pyramid shaped points extending outwardly in the direction of the second surface of the sponge body and is made level with the second surface of the sponge body when forces are applied to the first surface and subsequent back of scraper to manipulate the rigid scraper on a hard surface. The sponge body has three surfaces available for cleaning and scouring: the first surface, front scraper surface and second surface. The seamless second layer, third layer, third surface, and continuous side surface of the second and third layer are made of the same sponge-like cellulose material. As an alternative, the second layer, third layer, second surface, and the continuous side surface of the second and third layer are not made of the same material and the sponge body has at least four surfaces adapted for cleaning and scouring; the
(Continued)

first surface, scraper front surface, the continuous side surface of layer two and the second surface. As a second alternative, the scraper and aperture are placed on the width side of the scraper sponge.

19 Claims, 12 Drawing Sheets

(51) Int. Cl.
*A47L 13/02* (2006.01)
*A47L 13/08* (2006.01)

(56) References Cited

U.S. PATENT DOCUMENTS

| | | | | | |
|---|---|---|---|---|---|
| 4,414,700 | A | * | 11/1983 | Burns | A47L 13/02 15/105 |
| 5,806,135 | A | * | 9/1998 | Earle | A47L 13/16 15/104.001 |
| 2019/0313874 | A1 | * | 10/2019 | Omotola | A47L 13/16 |
| 2019/0365188 | A1 | * | 12/2019 | Omotola | A47L 13/16 |
| 2020/0078835 | A1 | * | 3/2020 | Kersey | A47L 13/16 |

* cited by examiner

SCRAPER SPONGE

BACKGROUND OF THE INVENTION

The present invention relates to sponges and, more particularly, to scraper sponges made of natural and/or man-made materials adapted for cleaning and scraping a desired area.

Sponges have been used for many years as a tool for cleaning cookware, utensils, kitchen and bathroom surfaces, automobile surfaces, windows, floors, furniture and a myriad of other objects and surfaces. Sponges are used in these applications in part because they are absorbent, reusable, lightweight, and easy to grasp and manipulate. However, a primary disadvantage of sponges is that by themselves, sponges are too soft and pliable to scrape away unwanted substances such as dirt, hardened oils or grease, mildew, and waxes or foods that stick and adhere to surfaces and reside in corners, grooves and crevices. To remedy this problem, abrasive layers have been added to sponges to enable users to scrape away substances. However, abrasive layers do not effectively allow users to remove substances residing in tight corners, grooves and crevices because neither the sponge nor the abrasive layer provide a rigid enough edge, particularly when saturated with liquid, to enable users to impart the requisite forces necessary for scraping and removing unwanted substances from these tight locations and, in some cases, from flat surfaces as well.

For the foregoing reasons, there is a need for a scraper sponge that enables users to effectively scrape away and remove unwanted substances adhering to flat surfaces and/or found in difficult to reach locations, is easy to grasp and manipulate, is lightweight, and is economical to manufacture for consumer use.

SUMMARY OF THE INVENTION

Sponges have been used for many years as a tool for cleaning cookware, utensils, kitchen and bathroom surfaces, automobile surfaces, windows, floors, furniture and a myriad of other objects and surfaces. Synthetic sponges, first developed by DuPont in 1940, have since largely replaced authentic sea sponges for household and industrial use.

Sponges are used because they are absorbent, reusable, and lightweight. However, a primary disadvantage of sponges is that by themselves, sponges are too soft and pliable to scrape away unwanted substances such as dirt, hardened oils or grease, mildew, and waxes or foods that stick and adhere to surfaces and reside in corners, grooves and crevices. Abrasive layers do not effectively allow users to remove substances residing in tight corners, grooves and crevices because neither the sponge nor the abrasive layer provide a rigid enough edge, to enable users to impart the requisite forces necessary for scraping and removing unwanted substances from the tight locations and from flat surfaces.

Several types of sponge/scraper implements have been proposed. For example, in U.S. Patent Application No. 2008/0216260 to Silverman et al., an integrated scraper and sponge device is disclosed. While this invention is an improvement upon the use of a sponge alone for removal of difficult and persistent deposits or films, it has several disadvantages. The attachment of the scraper portion to the sponge portion precludes use of the total sponge surface area, making the use of this device inconvenient and allowing the use of only one full surface of the sponge. In a second embodiment of the above invention, the scraper of the sponge is not securely inserted into the aperture in the sponge and this does not allow for easy grasp and use of the scraper without the sponge; the scraper is not wide. Also, use of the sponge in this manner can injure the hand as there is no support for the scraper in the soft sponge. Albeit, within the wet frictionless aperture of the sponge. Moreover, the pliable nature of the sponge make grasping the scraper portion all the more difficult for simple and effective removal of unwanted materials. In addition, the scraper is small and narrow which is not economical and requires excess scraping to cover a greater surface area. The inventor also does not describe how the blade is movably attached for the disclosed scraper design.

U.S. Pat. No. 7,984,527 to Georgieff discloses a scraper attachment for sponges that employs a large handle, attachable to the top surface of a sponge, for facile control of the sponge and ergonomic application of hand pressure for effective scraper action. While this device in an improvement over a sponge alone, its design is bulky, and makes access to tight areas difficult if not impossible. The scraper portion of the device does not include a serrated edge, and moreover the application of the device precludes complete use of the sponge surface area. As with the previous disclosure, this device only works with one type of sponge. Other examples include U.S. Pat. No. 4,724,568 to Englehardt, describing a scraper formed integrally with a sponge pad.

U.S. Pat. No. 9,138,121 to Baarsch et al. discloses a scraper attachment for select sponges. It requires the process of impaling a pointed rod through the sponge to work; this can be unsafe. It is bulky, not economical, and only one side of the sponge can be used with this device.

The consumer is faced with few choices of such devices that are currently available on the market, and further rebuffed by the limitations of such devices that have been disclosed above. Proctor and Gamble Company currently have at least two integrated sponge/scraper combination products on the market, distributed by Butler Home Products LLC. These products are largely not reusable, difficult to hold, and one of these products completely covers the top surface of the sponge, reducing the usable area of the sponge.

A flexible device to be used for all cleaning applications is currently not available on the market. Furthermore, the consumer cannot find a scraper sponge where the scraper doesn't impede use of the sponge, that is lightweight, easily grasped and manipulated, comfortable in the hand, allows use of four sides of the sponge and is economical to manufacture. Hence, there is a need for a scraper sponge of this magnitude.

DETAILED DESCRIPTION OF THE INVENTION

Figure 1:
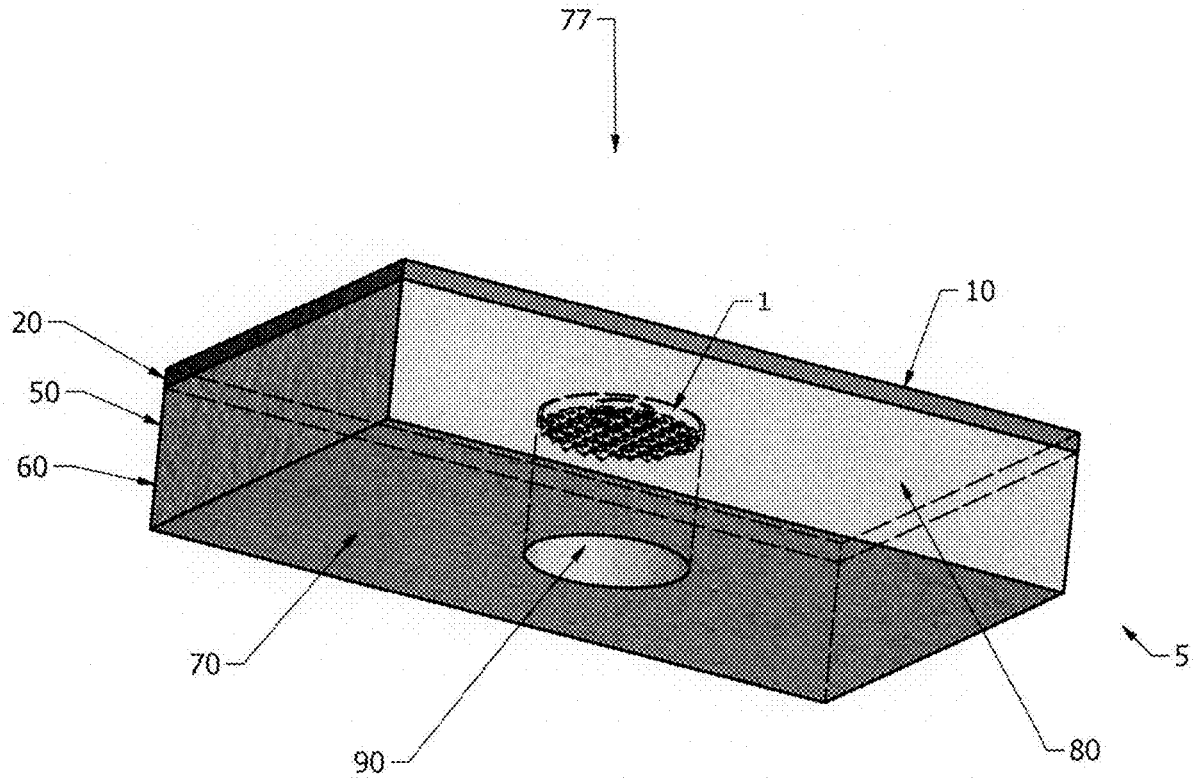
FIG. 1 is a bottom left sided semi-opaque view of the scraper sponge and all of its components according to an embodiment of the invention.
Figure 2:
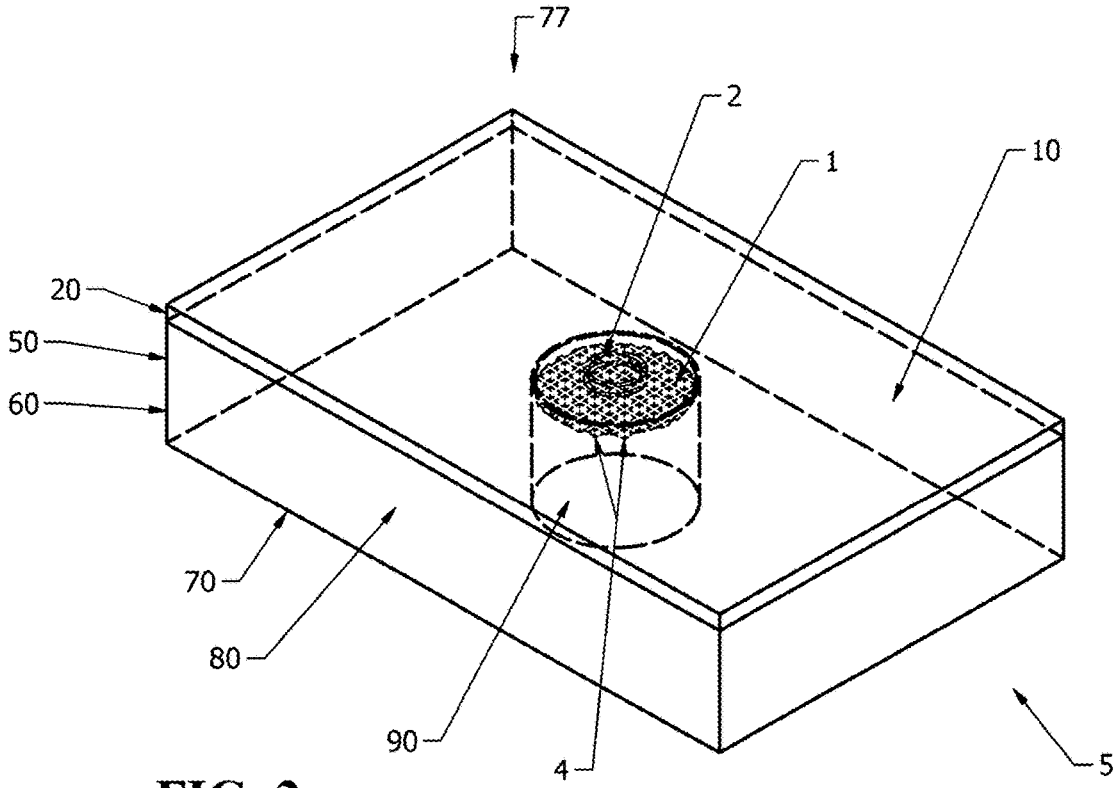
FIG. 2 is a top right-sided hidden line view of the scraper sponge and all of its components according to an embodiment of the invention.
Figure 3:
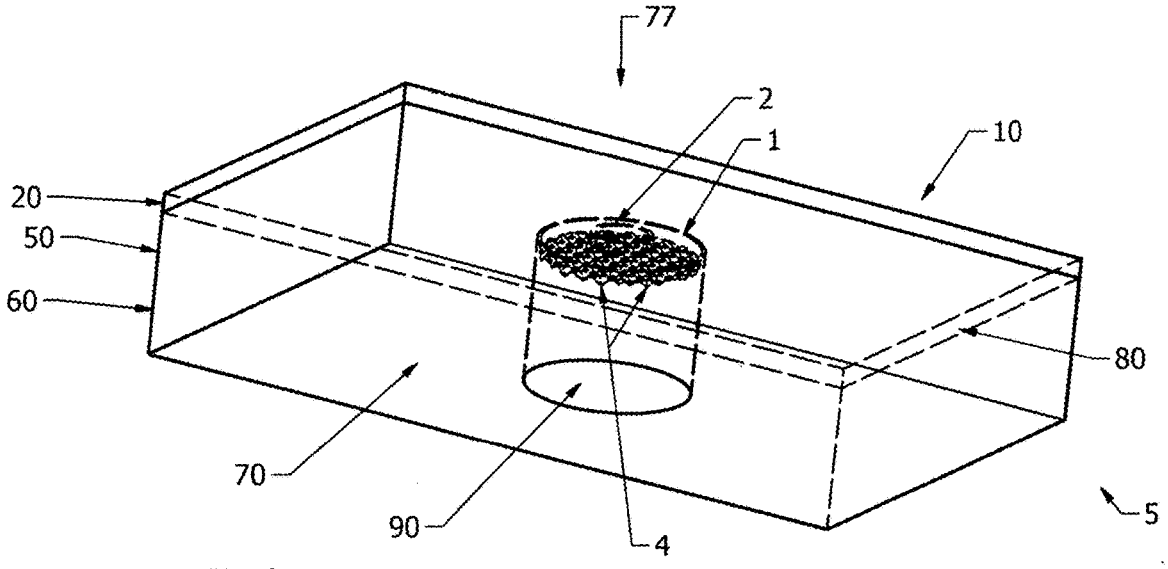
FIG. 3 is a bottom left-sided hidden line view of the scraper sponge and all of its components according to an embodiment of the invention.

The present invention is directed to a scraper sponge and/or pad adapted for scraping and removing unwanted substances such as dirt, hardened oils or grease, mildew, waxes, stuck on foods, or other substances that adhere to surfaces and reside in corners, grooves and crevices.

Referring to FIGS. (1 Thru 4) an embodiment of the scraper sponge is shown and generally indicated by reference numeral 5. The scraper sponge 77 comprises a sponge body 5 defining a first surface 10, second surface 70 opposite first surface, and a continuous side surface 80 around the perimeter. The sponge body 5 can be made from numerous materials such as polyester foam, natural sponges, polyurethane foams, cellulose fiber, absorbent arrays of synthetic fibers or any combination thereof. The invention is not limited in this regard, and any appropriate sponge material that is currently known or later becomes known to those skilled in the art may be used. In one embodiment, the sponge body 5 is rectangular. However, the invention is not limited in this regard as the sponge body 5 could be any shape appropriate for cleaning such as polygon, oval, square, circle, triangle, trapezoid, etc.

Figure 10:
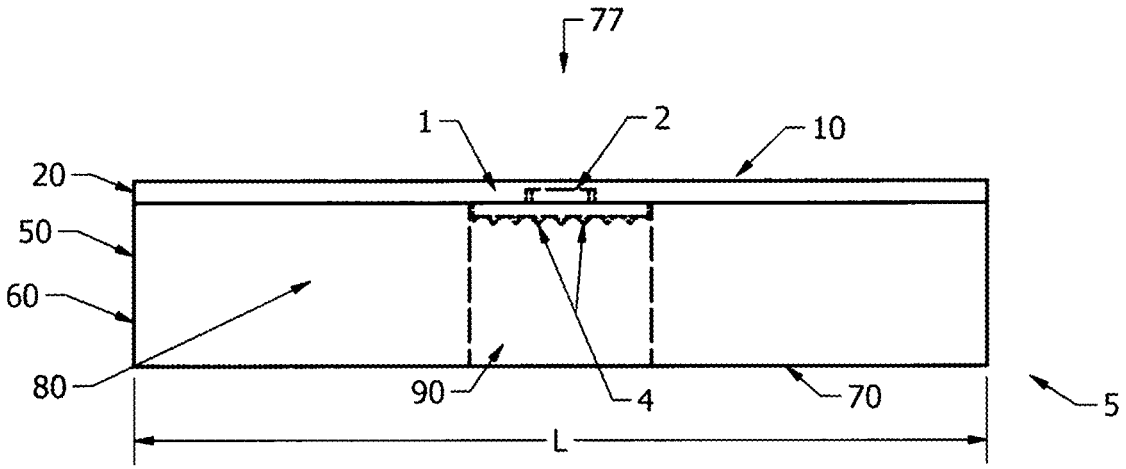
FIG. 10 is a transparent right-sided view of the scraper sponge and all of its components according to an embodiment of the invention.
Figure 11:
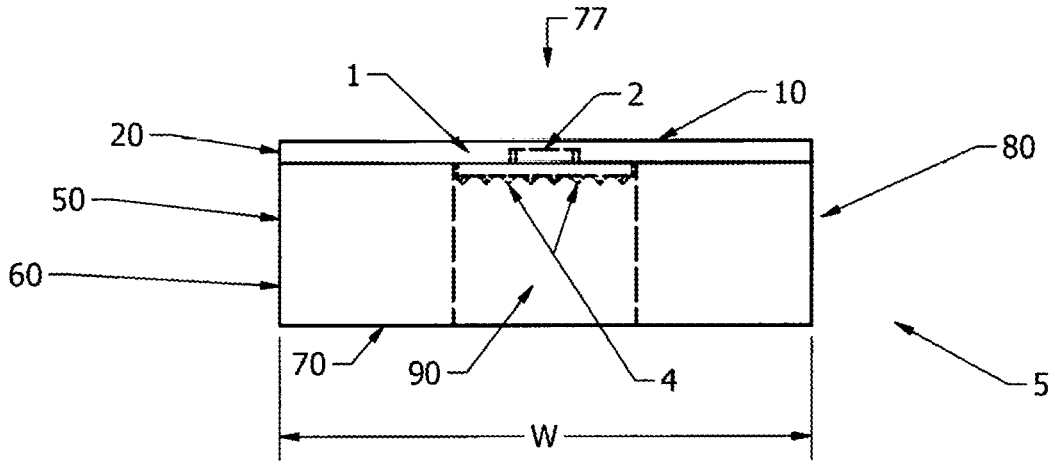
FIG. 11 is a transparent frontal view of the scraper sponge and all of its components according to an embodiment of the invention.
Figure 12:
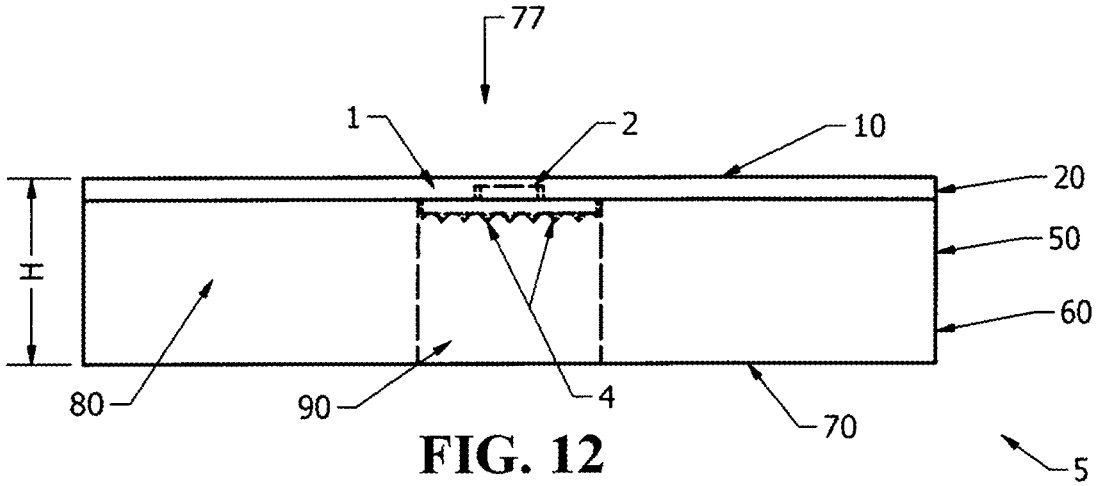
FIG. 12 is a transparent left-sided view of the scraper sponge and all of its components according to an embodiment of the invention.

Furthermore, the sponge body 5 is not limited by size in any dimension. In one embodiment, the length L (FIG. 10) of the sponge body 5 ranges from about 3 inches to about 23 inches, while the width W (FIG. 11) ranges from about 2 inches to about 15 inches; for circular sponges (not shown), the diameter ranges from about 3 inches to about 16 inches. In another embodiment, the length L of the sponge body 5 ranges from about 3 inches to about 14 inches, while the width W ranges from about 2 inches to about 7 inches; for circular sponges, the diameter ranges from about 3 inches to about 12 inches. In yet another embodiment, the length L of the sponge body 5 ranges from about 4 inches to about 12 inches, while the width W ranges from about 2 inches to about 4 inches; for circular sponges, the diameter ranges from about 4 inches to about 8 inches. With respect to the thickness H (FIG. 12) of the sponge body 5, in one embodiment, the thickness H ranges from about 1 inch to about 5 inches. In another embodiment, the thickness H of the sponge body 5 ranges from about 1 inch to about 7 inches. In yet another embodiment, the thickness H of the sponge body 5 ranges from about 1 inch to about 3 inches.

Figure 4:
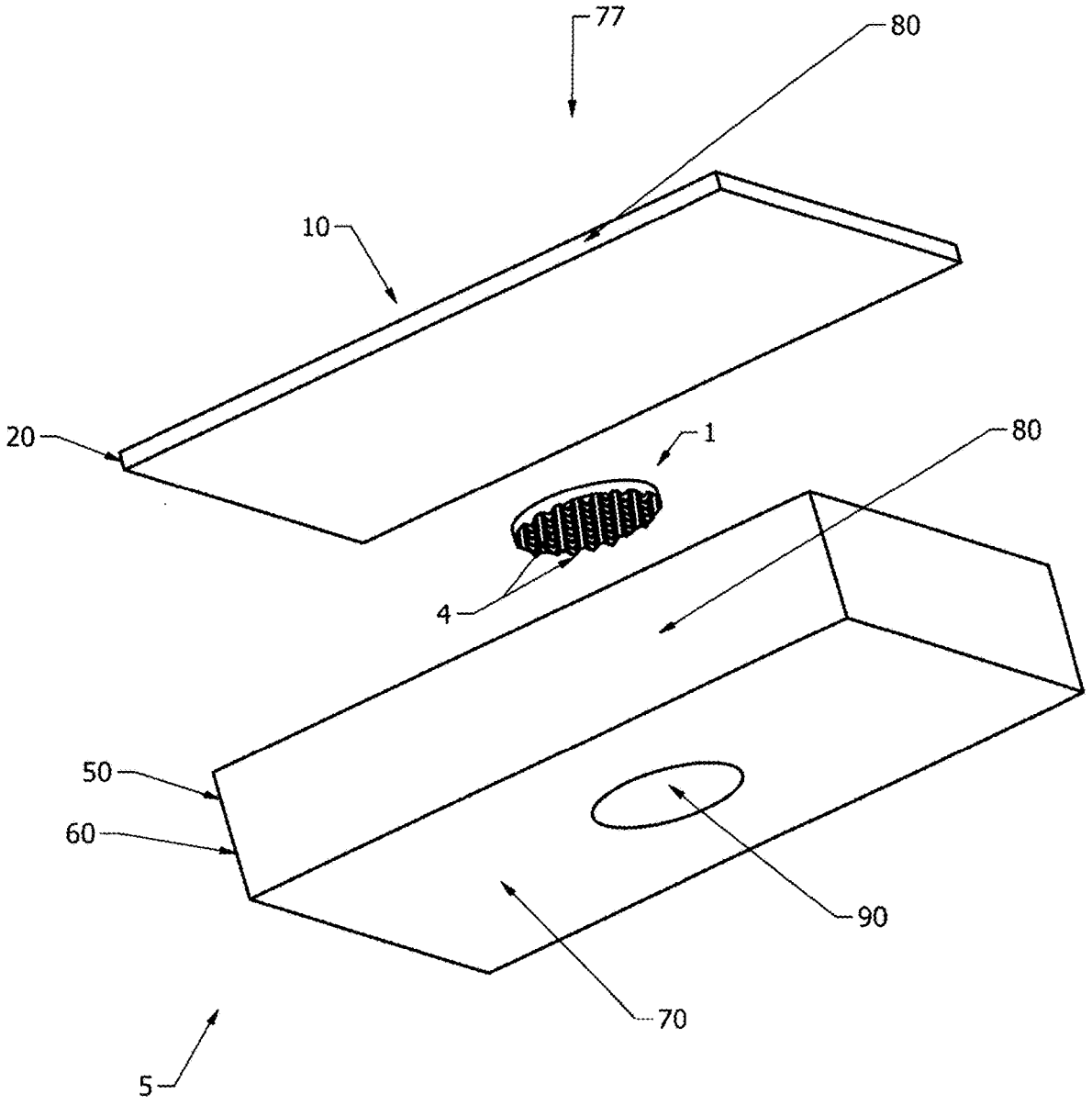
FIG. 4 is an exploded right-sided bottom view of the scraper sponge and all of its components according to an embodiment of the invention.
Figure 13:
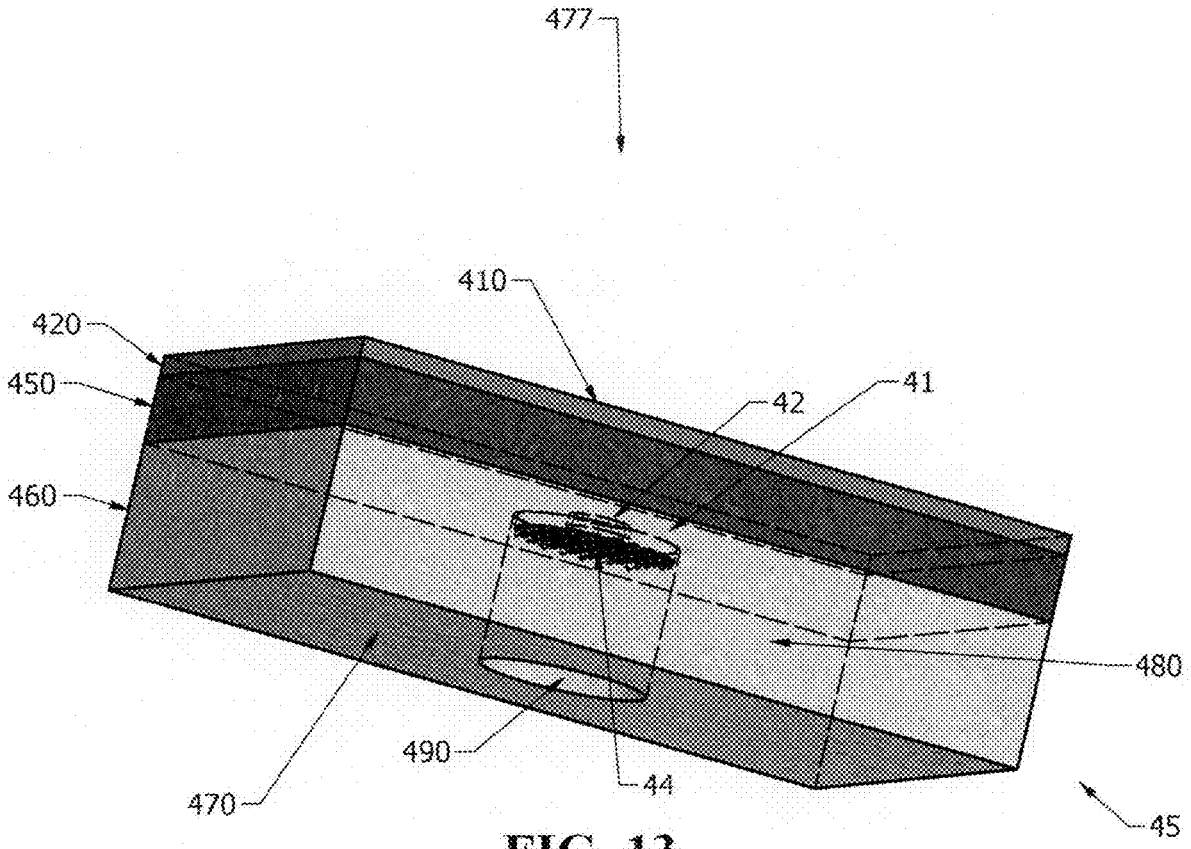
FIG. 13 is a bottom left sided semi-opaque view of the scraper sponge and all of its components according to a second embodiment of the invention.
Figure 14:
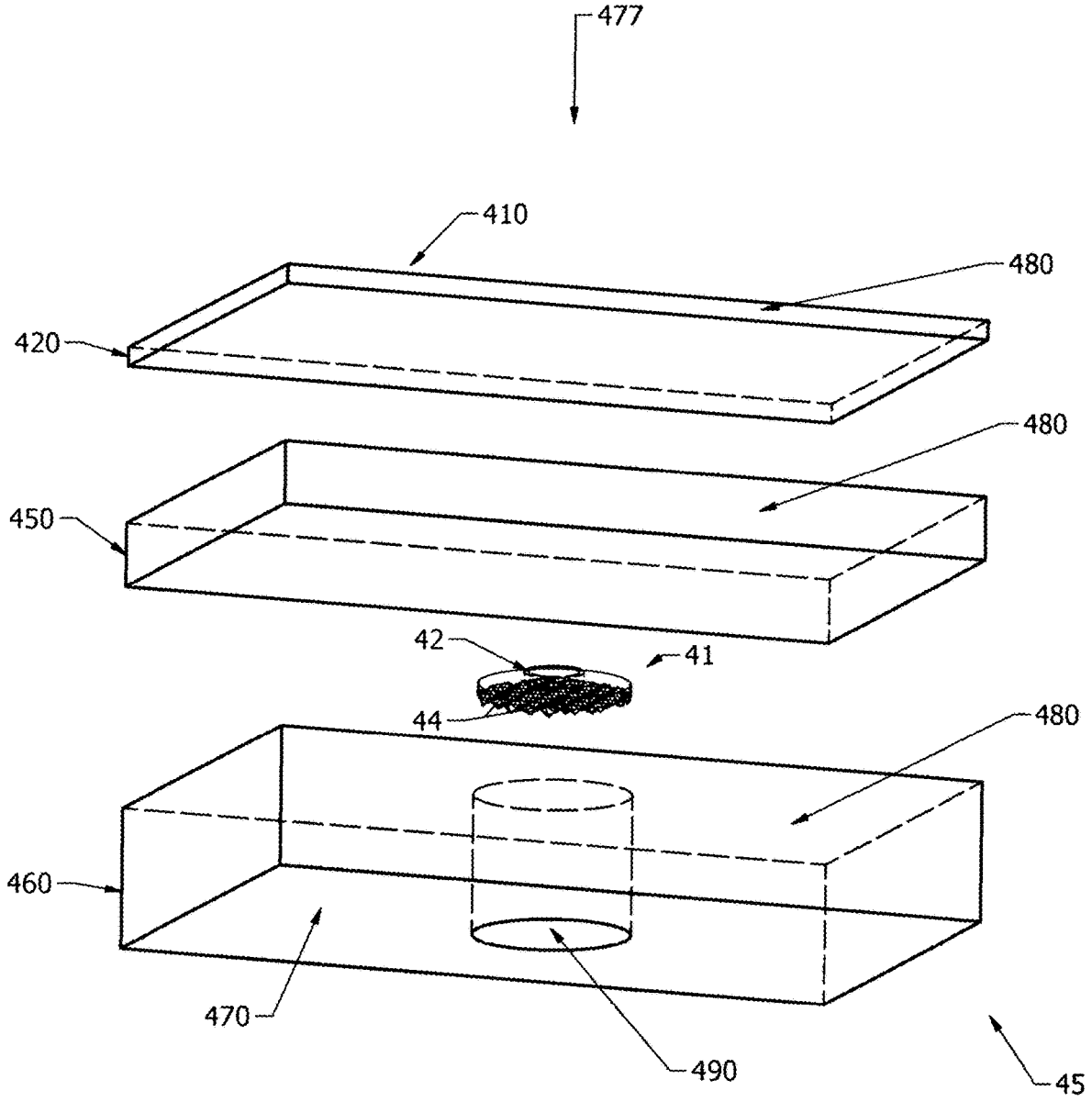
FIG. 14 is an exploded left sided hidden line view of the scraper sponge and all of its components according to a second embodiment of the invention.

Referring to FIGS. (1 thru 3) the scraper sponge 77 defines a sponge body 5 defining an outer continuous side surface 80 including a first surface 10, a second surface 70, and a scraper 1 inserted into a circular aperture 90 approximately through the middle of the seamless second layer 50, third layer 60, and the second surface. An exploded view of the scraper sponge 77 is shown in FIG. 4. In one embodiment, the rear of scraper 1 is fixedly secured to first layer 20 where it joins second layer 50 within the circular aperture 90 of sponge body 5 of FIG. 1 by way of heat fusion and/or the application of an adhesive (not shown), or by any other method that is currently known or later becomes known to one skilled in the art. In another embodiment, (FIG. 13) the rear of scraper 1 can be fixedly secured to second layer 50 where it joins third layer 60 within circular aperture 90 of sponge body 5 approximately in the middle of third layer 60 by way of the second surface 70 of (FIG. 13). An exploded view of this is presented in FIG. 14.

Figure 5A:
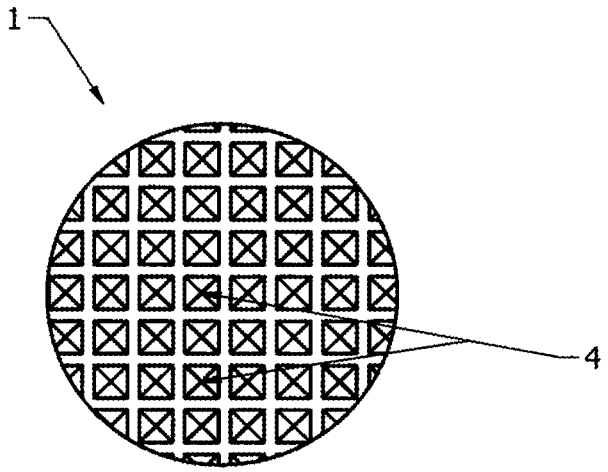
FIG. 5A is a front view of the scraper according to an embodiment of the invention.
Figure 5B:
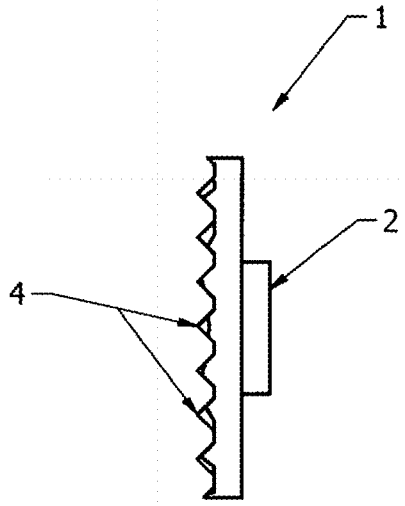
FIG. 5B is a side view of the scraper and its components according to an embodiment of the invention.
Figure 5C:
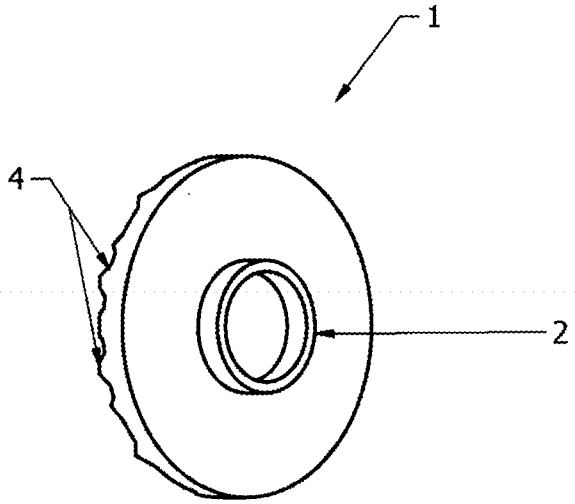
FIG. 5C is a right-sided view of the scraper sponge and all of its components according to an embodiment of the invention.

The rear of scraper 1 (FIG. 5C) is securely attached to the sponge body 5. The scraper 1 can be any size. The scraper 1 on its front surface (FIG. 5A) has approximately 70 defined pyramid shaped edges 4, depending on the surface area of the scraper 1 (FIGS. 5A and 5B). The pyramid shaped edges 4 extend outwardly toward the second surface 70. The scraper 1 pyramid shaped edges 4 range from being semi rigid to substantially rigid for scraping unwanted substances and is narrow at its circular border for entering tight corners, groves and crevices and for effectively scraping surfaces. The scraper 1 can be any shape; circular, rectangular, polygonal. Further, the letter O shaped ring 2 on the rear of scraper 1 defines a depressible surface concave female groove to which normal and angular forces are applied by way of the first surface 10 by the user to manipulate the scraper 1 and apply pressure as required to scrape away and remove substances where desired. The scraper 1 can be made from numerous materials such as natural rubber, synthetic rubber, plastics, polymers, wood, metal or any combination thereof. The invention is not limited in this regard, and any appropriate scraper material that is currently known or later becomes known to those skilled in the art may be used. For improved manipulation and scraping, the rear surface of the scraper has a letter O shaped ring 2 that is contoured in a concave-like manner and, depending on the size of the scraper 1, is adapted for receiving at least a portion of a human finger for applying pressure and manipulating the scraper 1 as noted above.

Figure 6:
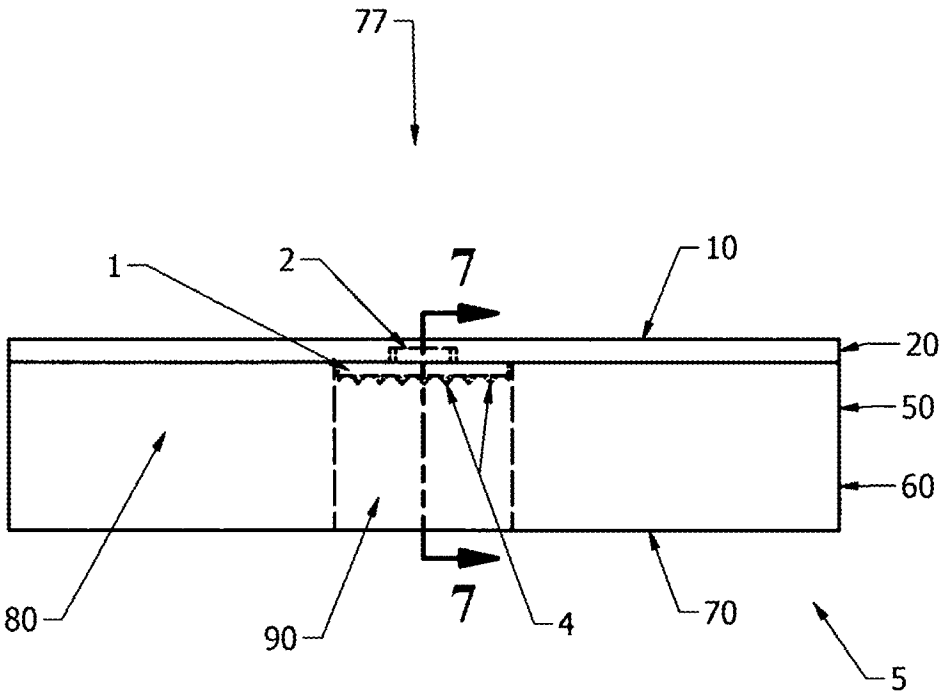
FIG. 6 is a transparent right-sided view of the scraper sponge and all of its components according to an embodiment of the invention.
Figure 7:
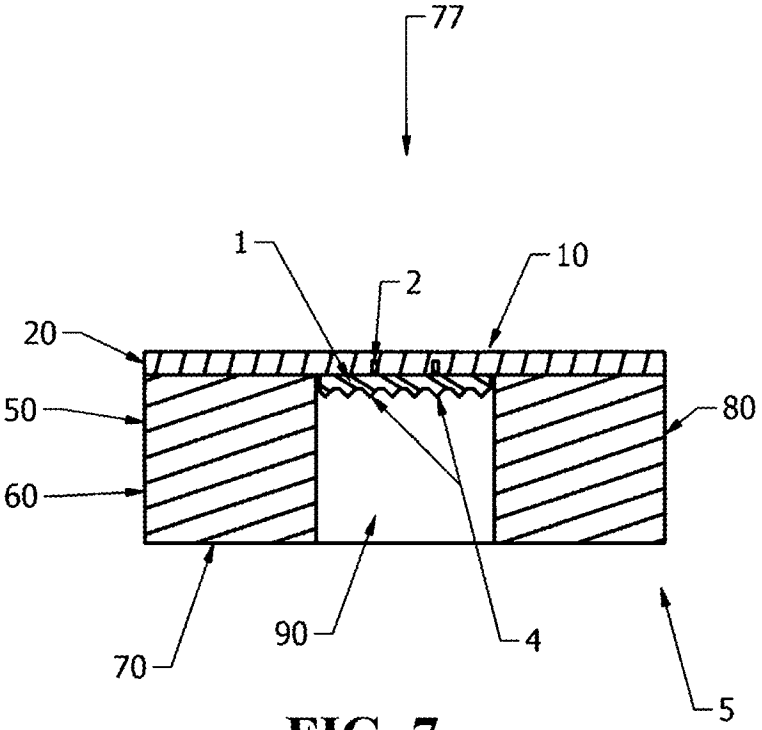
FIG. 7 is a front section view of FIG. 6 according to an embodiment of the invention.
Figure 8:
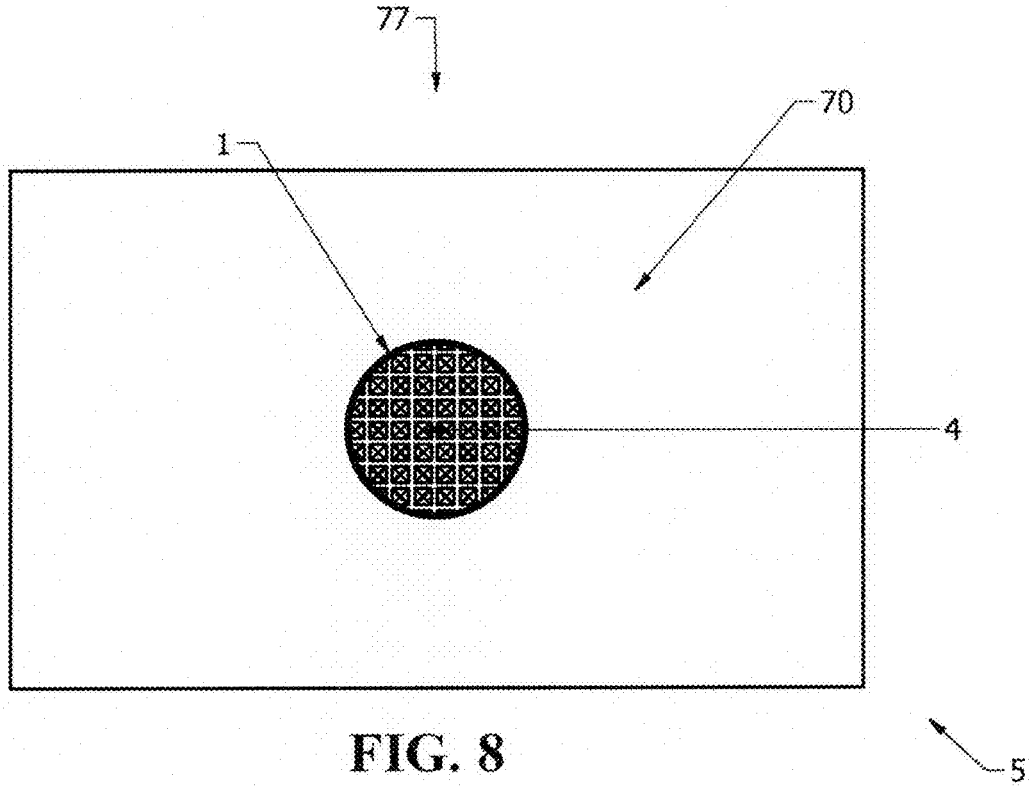
FIG. 8 is a bottom view of the scraper sponge according to an embodiment of the invention.
Figure 9:
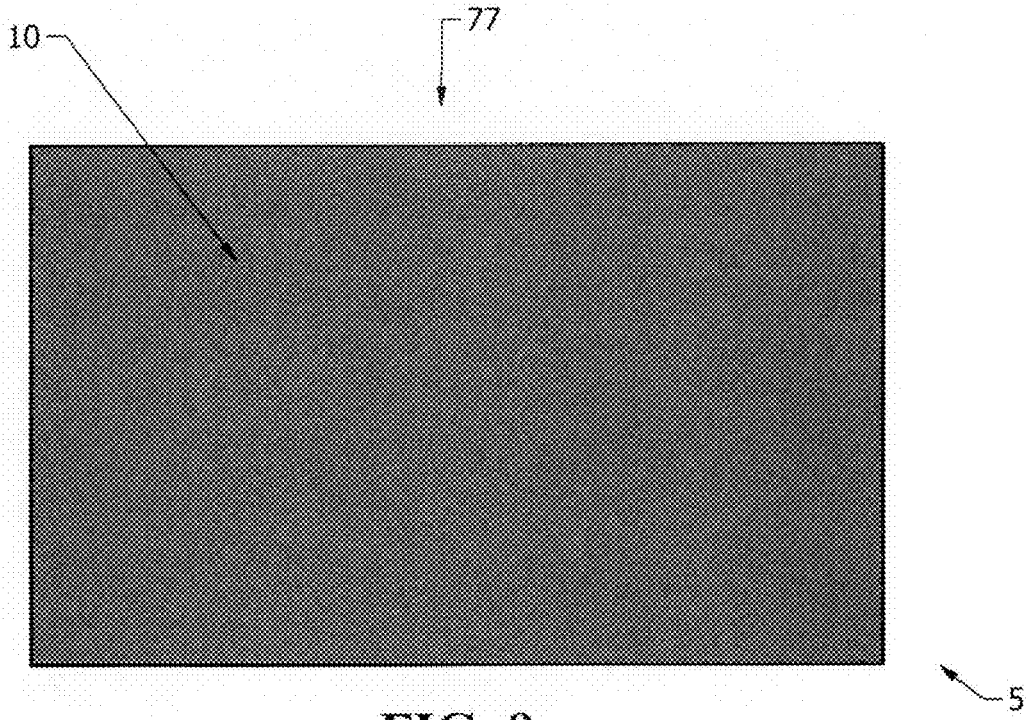
FIG. 9 is a top view of the scraper sponge according to an embodiment of the invention.
Figure 15:
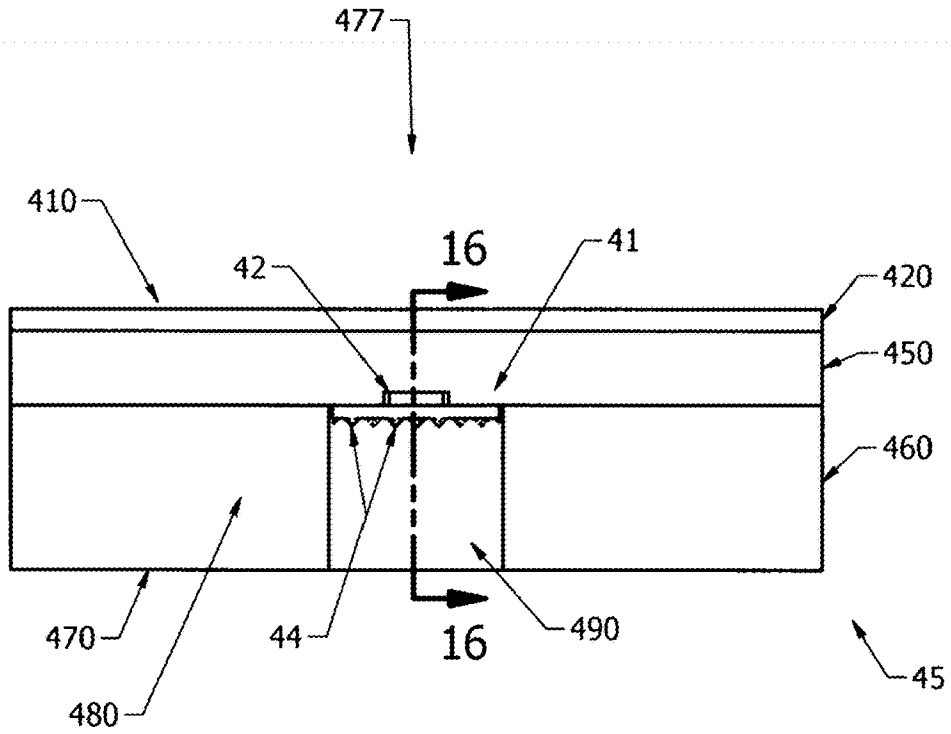
FIG. 15 is a transparent left-sided view of the scraper sponge and all of its components according to a second embodiment of the invention.
Figure 16:
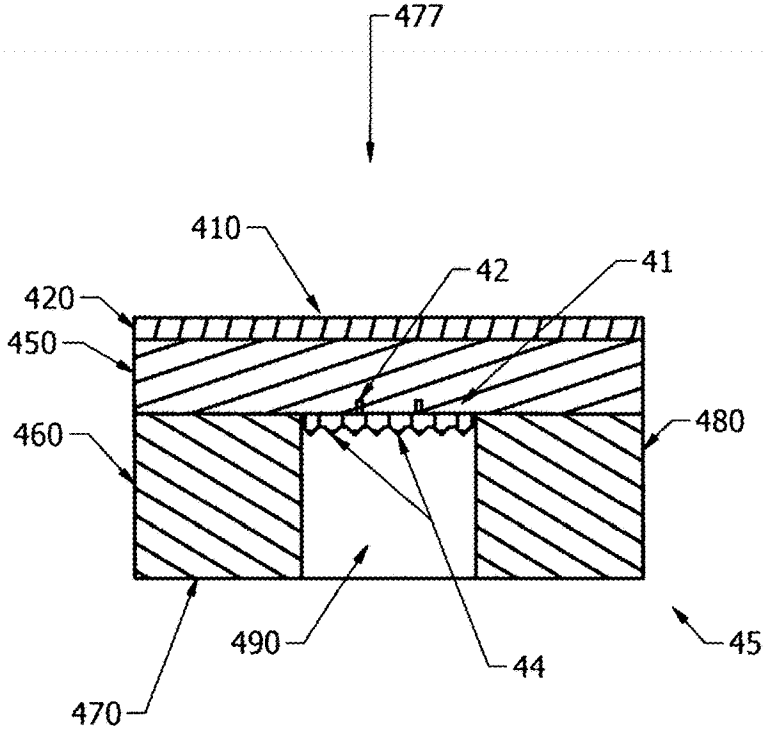
FIG. 16 is a front section view of FIG. 15 according to a second embodiment of the invention.

In one embodiment, shown in (FIG. 1), the sponge body 5 comprises multiple layers including a first layer 20 defining the first surface 10 and a second layer 50 defining a third layer 60 defining a second surface 70. The first layer 20 and second layer 50 are heat fused and/or bonded together using an adhesive (not shown), or by any method that is currently known or later becomes known to those skilled in the art. In one embodiment, the second layer 50, third layer 60, and second surface 70, are made of the same material and are seamlessly heat fused and/or bonded together using an adhesive (not shown), or by any method that is currently known or later becomes known to those skilled in the art. The first surface 10 and first layer 20 can be made from numerous materials such as nylon, polypropylene, polyester foam, melamine, natural sponges, polyurethane foams, cellulose, and absorbent arrays of synthetic fibers, non-woven materials or any combination thereof. The second layer 50, third layer 60, and second surface 70, can be made from numerous materials such as nylon, polypropylene, polyester foam, melamine, natural sponges, polyurethane foams, cellulose, and absorbent arrays of synthetic fibers, non-woven materials or any combination thereof. In one embodiment, the first surface 10 and first layer 20 are made from nylon. The second layer 50, third layer 60, and second surface 70 are indistinguishable and made from cellulose fiber. In one embodiment, (FIGS. 6 and 7), the rear of scraper 1 is secured to layer 1 and fits securely into the circular aperture 90 approximately through the middle of layer two and layer three and second surface 70. The thickness of the second layer 50 and third layer 60 may comprise approximately 85% to about 90% of the total thickness of the scraper sponge 77. Preferably, the first layer 20 comprises between about 10% to about 20%, of the total thickness of the scraper sponge 77. In an alternative embodiment, (FIGS. 13, 15 and 16) the first layer 420 and second layer 450 comprise about 40% of the total thickness of the sponge body 477 and the third layer 460 comprises about 60%. All three layers can be made of different types of surface scrubbing materials.

Referring now to (FIGS. 13, 15, and 16), an alternative embodiment is shown where like numerals represent like elements and are preceded with the number "4". In this embodiment, the scraper sponge 477 defines a sponge body 45 defining an outer surface including a first surface 410, a first layer 420, a second layer 450, a third layer 460 including a second surface 470, a continuous side surface 480, and a circular aperture 490 extending through the second surface 470 and third layer 460 for receiving the scraper 41. The rear of scraper 41 (FIG. 5C) is fixedly secured to layer two 450 where it borders layer three 460 within the circular aperture 490 by way of heat fusion or by an adhesive (not shown), and like the scraper described above, has approximately 70 three dimensional pyramid shaped cones defining edges 44 and a depressible groove like surface 42 on the rear of scraper 41 to which forces are applied to manipulate the scraper 41. For improved manipulation and scraping, the depressible surface 42 on the rear of scraper 41 is contoured in a concave-like manner and, depending on the size, is adapted for receiving at least a portion of: (i) a human finger, (ii) multiple human fingers, (iii) a human hand, or (iv) two human hands, for applying pressure and manipulating the scraper 41 as noted above. The scraper edges 44 extend outwardly from within the aperture 490 in the sponge body 45. In this embodiment the materials used for the sponge body 45 and scraper 41 are consistent with the materials used in connection with the sponge body 5 and scraper 1 described above. As noted above, the sponge body 45 can comprise a first layer 420, a second layer 450, a third layer 460 and a second surface 470. At least one of the second layer 450 or third layer 460 defines the circular aperture 490 through which the scraper 41 extends. The materials used for the first surface 410, first layer 420, second layer 450, third layer 460 and second surface 470 are consistent with the materials used in connection with the sponge body 5 and scraper 1 described above. One advantage of this embodiment is that it allows each layer 420, 450, and 460 to be made of a different textured material to be used for scrubbing and cleaning and/or polishing a surface. For example, layer one 420 can be made of a coarse grain scouring material, the continuous side surface 480 of the second layer 450 can be made of a melamine resin material, and the third layer 460 can be made of cellulose fiber.

Figure 17:
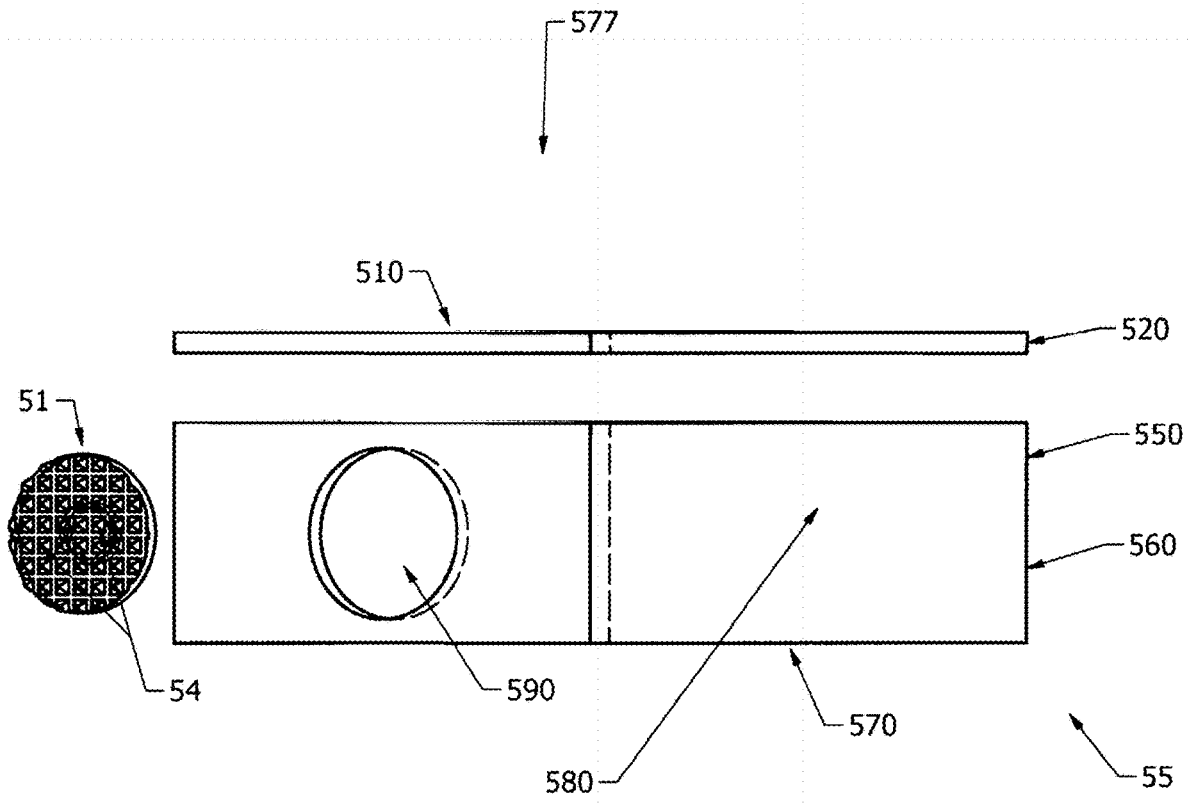
FIG. 17 is an angled and exploded side view of the scraper sponge and all of its components according to a third embodiment of the invention.
Figure 18:
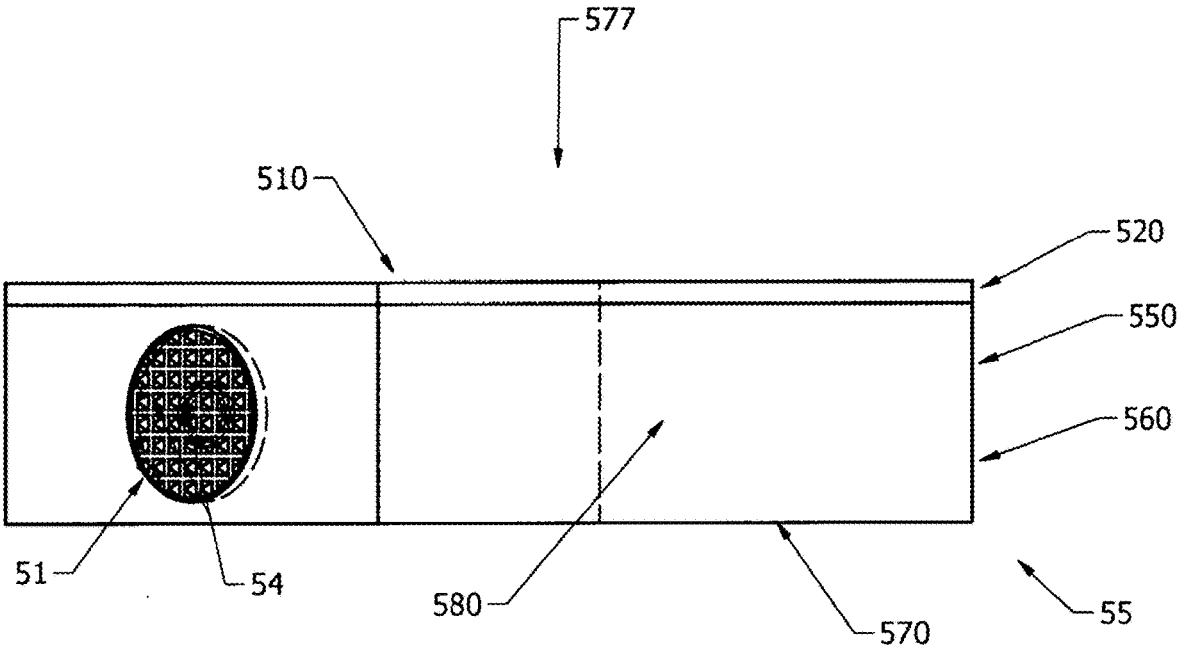
FIG. 18 is an angled side view of the scraper sponge and all of its components according to a third embodiment of the invention.
Figure 19:
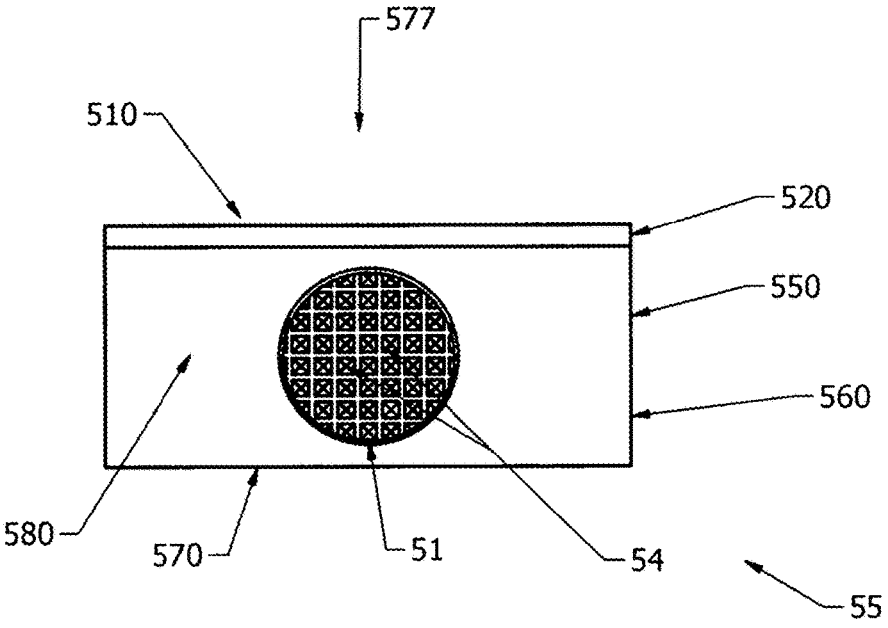
FIG. 19 is a width side view of the scraper sponge and all of its components according to a third embodiment of the invention.

Referring now to FIGS. 17, 18, and 19) a third alternative embodiment is shown where like numerals represent like elements and are preceded with the number "5". In this embodiment, the scraper sponge 577 defines a sponge body 55 defining an outer surface including a first surface 510, a first layer 520, a second layer 550, a third layer 560 including a second surface 570, a continuous side surface 580, and a circular aperture extending into the continuous side surface 580 on the width side of scraper sponge 577 for receiving the scraper 51. The rear of scraper 51 (FIG. 5C) is fixedly secured within the continuous side surface to layer two 550 and layer three 560 within the circular aperture 590 by way of heat fusion or by an adhesive (not shown), and like the scraper described above, has approximately 70 three dimensional pyramid shaped cones defining edges 54 and a depressible groove like surface 52 on the rear of scraper 51 to which forces are applied to manipulate the scraper 51. The scraper edges 54 extend outwardly from within the aperture 590 in the sponge body 55. In this embodiment the materials used for the sponge body 55 and scraper 51 are consistent with the materials used in connection with the sponge body 45 and scraper 41 described above. As noted above, the sponge body 55 can comprise a first layer 520, a second layer 550, a third layer 560, a second surface 570 and a continuous side surface 580. At least one of the second layer 550 or third layer 560 defines the circular aperture 590 through which the scraper 51 extends. The materials used for the first surface 510, first layer 520, second layer 550, third layer 560 and second surface 570 are consistent with the materials used in connection with the sponge body 5 and scraper 1 described above. One advantage of this embodiment is that the entire surface area of the second surface can be used as a liquid absorbing cleaning apparatus.

In light of the above description of the scraper sponge 77, 477, and 577 an example of its use will now be described. With the scraper sponge 77, 477, 577 and/or the desired object or surface for cleaning (not shown) prepared with water, soap, cleaning liquids, cleaning powders, or the like, the user places the sponge body 5, 45, 55 in contact with said object or surface and moves the sponge body 5, 45, 55 in a circular and/or back and forth motion to remove unwanted substances from the surface. To remove harder and more stubborn substances the user places the scraper 1, 41, 51 over the substance and places a downward pressure on the rear of the scraper 1, 41, 51. The sponge body through which pressure is applied to the scraper 1, 41, 51 and, in particular, the middle of the scraper, is compressed thereby allowing the scraper 1, 41, 51 to extend through the circular aperture 90, 490, 590 into a position for contacting and scraping unwanted substances in a desired location. While maintaining the applied pressure, the user simultaneously moves the sponge body 5, 45, 55 and scraper 1, 41, 51 in, for example, a forward or reciprocating motion to effectively scrape away and remove the unwanted substances. When the user is finished, both the sponge body and scraper can be cleaned for future applications. It should be noted that the sponge body 5, 45, 55 can be used for cleaning and scouring purposes without engaging the scraper 1, 41, 51. Further, the scraper sponge 77, 477, 577 can be used in a dry state without the addition of water, soap, cleaning liquids, cleaning powders, or the like.

The claimed invention is:

1. A scraper sponge for cleaning and scraping away unwanted substances from an object or surface, comprising:

a sponge body having a first layer with a first surface, a second layer, a third layer with a second surface opposite the first surface, and a continuous side surface around a perimeter of the sponge body; and a scraper having a back surface and a front surface, wherein the back surface of the scraper is secured to the first layer opposite the first surface within a circular aperture extending through and approximately in the middle of the second layer, the third layer and the second surface of the sponge body;

wherein the front surface of the scraper is covered with pyramid shaped edges extending outwardly in a direction of the second surface of the sponge body; and wherein the front surface of the scraper is made level with the second surface of the sponge body when forces are applied to the first surface and the back surface of the scraper to manipulate the scraper on a hard surface.

2. The scraper sponge of claim 1, wherein said sponge body is made of material selected from the group consisting of polyester foam, natural sponges, polyurethane foams, cellulose, absorbent arrays of synthetic fibers and any combination thereof.

3. The scraper sponge of claim 1, wherein said scraper is made of material selected from the group consisting of natural rubber, synthetic rubber, polymers, wood, metal, and any combination thereof.

4. The scraper sponge of claim 3, wherein said scraper has a surface area smaller than a surface area of the scraper sponge.

5. The scraper sponge of claim 3, wherein said scraper is thin and circular in shape.

6. The scraper sponge of claim 3, wherein the back surface of said scraper is fixedly secured to the first layer opposite the first surface by way of an adhesive, by heat fusion, or by any combination thereof.

7. The scraper sponge of claim 3, wherein said scraper is defined by the first layer and the circular aperture.

8. The scraper sponge of claim 3, wherein said back surface has a three-dimensional letter O shaped ring with a concave groove therein.

9. The scraper sponge of claim 3, wherein said front surface of the scraper has approximately 70 three-dimensional pyramid shaped edges, that are at least one of (i) semi rigid and (ii) substantially rigid, attached thereto.

10. The scraper sponge of claim 1, wherein said scraper is square, rectangular, or polygonal in shape.

11. The scraper sponge of claim 1, wherein said first surface and the first layer are made of a coarse textured scouring material.

12. The scraper sponge of claim 11, wherein the thickness of said first layer is between approximately 10% and about 15% of the thickness of the scraper sponge.

13. The scraper sponge of claim 1, wherein said second layer is made of cellulose fiber.

14. The scraper sponge of claim 13, wherein the total thickness of said second layer is approximately 40% to about 45% of the total thickness of the scraper sponge.

15. The scraper sponge of claim 1, wherein said third layer is made of cellulose fiber.

16. The scraper sponge of claim 15, wherein the total thickness of said third layer is between about 40% to about 45% of the total thickness of the scraper sponge.

17. The scraper sponge of claim 1, wherein the second layer is seamlessly attached to the third layer.

18. A scraper sponge for cleaning and scraping away unwanted substances from an object or surface, comprising:

a sponge body having a first layer with a first surface, a second layer, a third layer with a second surface opposite the first surface, and a continuous side surface around a perimeter of the sponge body; and a scraper having a back surface and a front surface, wherein the back surface of the scraper is secured to the second layer adjacent to the third layer within an aperture extending through and approximately in the middle of the third layer and the second surface of the sponge body;

wherein the front surface of the scraper is covered with pyramid shaped edges extending outwardly in a direction of the second surface of the sponge body and wherein the front surface of the scraper is made level with the second surface of the sponge body when forces are applied to the first surface and the back surface of the scraper to manipulate the scraper on a hard surface;

wherein said scraper is made of a material selected from the group consisting of: natural rubber, synthetic rubber, polymers, wood, metal, and any combination thereof;

wherein the back surface of said scraper is secured to the second layer opposite the first surface by way of an adhesive, by heat fusion, or by any combination thereof; and wherein said back surface has a three-dimensional letter O shaped ring with a concave groove therein.

19. The scraper sponge of claim 18, wherein said second layer is made of melamine and the continuous side surface is made of a coarse textured scouring material.

* * * * *